US011605496B2

(12) United States Patent
Roessler et al.

(10) Patent No.: US 11,605,496 B2
(45) Date of Patent: Mar. 14, 2023

(54) FOIL WOUND MAGNETIC ASSEMBLIES WITH THERMALLY CONDUCTIVE TAPE AND METHODS OF ASSEMBLING SAME

(71) Applicant: ABB Power Electronics Inc., Plano, TX (US)

(72) Inventors: Robert Joseph Roessler, Wylie, TX (US); Anjana Shyamsundar, McKinney, TX (US)

(73) Assignee: ABB SCHWEIZ AG, Baden (CH)

( * ) Notice: Subject to any disclaimer, the term of this patent is extended or adjusted under 35 U.S.C. 154(b) by 588 days.

(21) Appl. No.: 15/948,383

(22) Filed: Apr. 9, 2018

(65) Prior Publication Data

US 2019/0311840 A1 Oct. 10, 2019

(51) Int. Cl.

| | |
|---|---|
| ***H01F 27/32*** | (2006.01) |
| ***H01F 27/28*** | (2006.01) |
| ***H01F 41/063*** | (2016.01) |
| ***H01F 27/24*** | (2006.01) |

(52) U.S. Cl.

CPC ..... *H01F 27/2876* (2013.01); *H01F 27/24* (2013.01); *H01F 27/28* (2013.01); *H01F 27/32* (2013.01); *H01F 41/063* (2016.01)

(58) Field of Classification Search

CPC .... H01F 27/2876; H01F 27/28; H01F 41/063; H01F 27/32; H01F 27/24; H01F 27/2847

See application file for complete search history.

(56) References Cited

U.S. PATENT DOCUMENTS

| | | | | |
|---|---|---|---|---|
| 2,998,583 | A * | 8/1961 | Worcester | H01F 30/10 216/33 |
| 3,112,556 | A * | 12/1963 | Zack | H01F 41/122 29/605 |
| 3,225,269 | A * | 12/1965 | Worcester | H02K 3/18 335/282 |
| 3,555,670 | A * | 1/1971 | Zickar et al. | H01F 27/2847 29/605 |
| 3,659,191 | A * | 4/1972 | Spreadbury | G05F 3/06 323/248 |
| 4,086,552 | A | 4/1978 | Baggermans | |
| 4,751,488 | A * | 6/1988 | Lanoue | H01B 3/308 336/84 R |
| 4,819,322 | A * | 4/1989 | Higuchi | H01F 41/04 29/605 |
| 5,600,222 | A | 2/1997 | Hall et al. | |
| 5,805,045 | A | 9/1998 | Henninger | |
| 6,087,916 | A | 7/2000 | Kutkut et al. | |
| 6,535,100 | B2 | 3/2003 | Forss | |
| 7,990,246 | B2 | 8/2011 | Lindholm et al. | |
| 9,196,407 | B2 | 11/2015 | Bockholt et al. | |

(Continued)

FOREIGN PATENT DOCUMENTS

| | | | | |
|---|---|---|---|---|
| CN | 105448496 | A * | 3/2016 | |
| JP | 2011082387 | A * | 4/2011 | |
| JP | 2012114122 | A * | 6/2012 | H01F 27/008 |

*Primary Examiner* — Tuyen T Nguyen

(74) *Attorney, Agent, or Firm* — Armstrong Teasdale LLP

(57) ABSTRACT

A magnetic assembly includes a magnetic core including at least one winding leg and at least one winding. The at least one winding inductively coupled to the magnetic core and wound around the at least one winding leg. The at least one winding includes a foil conductive material and a tape. The tape includes a thermally conductive adhesive layer and an electrically insulating layer.

20 Claims, 3 Drawing Sheets

(56) References Cited

U.S. PATENT DOCUMENTS

| | | | | |
|---|---|---|---|---|
| 9,773,608 | B2 | 9/2017 | Ratz et al. | |
| 2013/0293340 | A1 | 11/2013 | Weber et al. | |
| 2014/0112044 | A1* | 4/2014 | Kawaguchi | H01F 41/04 363/131 |
| 2017/0221625 | A1 | 8/2017 | Sullivan et al. | |
| 2017/0278620 | A1* | 9/2017 | Ito | H02K 3/30 |

* cited by examiner

FOIL WOUND MAGNETIC ASSEMBLIES WITH THERMALLY CONDUCTIVE TAPE AND METHODS OF ASSEMBLING SAME

BACKGROUND

The field of the invention relates generally to power electronics, and more particularly, to foil wound magnetic assemblies with thermally conductive tape for use in power electronics.

High density power electronic circuits often require the use of magnetic electrical components for a variety of purposes, including energy storage, signal isolation, signal filtering, energy transfer, and power splitting. As the demand for higher power density electrical components increases, the heat generated by components also increases. The heat generated by these higher power density electrical components must be dissipated for these devices to properly operate. Additionally, high density power electronic circuits are also shrinking such that the circuits occupy less overall volume. As the overall volume of the circuits decreases, the volume of the magnetic assemblies and heat dissipation devices within the magnetic assemblies also need to decrease. However, conventional heat dissipation devices (e.g., heat pipes and potting) are bulky and are generally positioned outside of the magnetic assemblies.

BRIEF DESCRIPTION

In one aspect, an magnetic assembly is provided. The magnetic assembly includes a magnetic core including at least one winding leg and at least one winding. The at least one winding inductively coupled to the magnetic core and wound around the at least one winding leg. The at least one winding includes a foil conductive material and a tape. The tape includes a thermally conductive adhesive layer and an electrically insulating layer.

In another aspect, a method of assembling a magnetic assembly is provided. The method includes providing a magnetic core including at least one winding leg. The method also includes providing at least one winding. The at least one winding includes a foil conductive material and a tape. The tape includes an electrically insulating layer and at least one thermally conductive adhesive layer. The method further includes inductively coupling the at least one winding to the magnetic core by winding the at least one winding around the at least one winding leg.

In yet another aspect a magnetic assembly is provided. The magnetic assembly includes a magnetic core including at least one winding leg and at least one winding. The at least one winding inductively is coupled to the magnetic core and wound around the at least one winding leg. The at least one winding includes a foil conductive material and a tape. The tape includes an electrically insulating layer and two thermally conductive adhesive layers positioned on opposite sides of the at least one electrically insulating layer.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Figure 1:
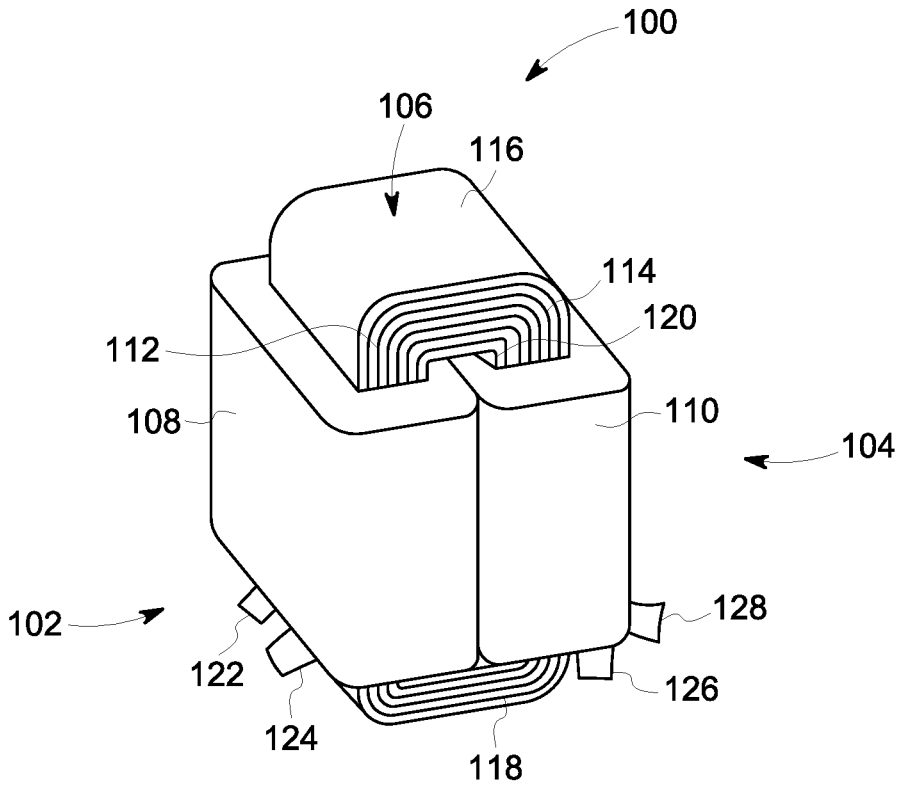
FIG. 1 is a perspective view of an example magnetic assembly.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged; such ranges are identified and include all the sub-ranges contained therein unless context or language indicates otherwise.

Example embodiments of magnetic assemblies are described herein. A magnetic assembly includes a magnetic core, an input winding inductively coupled to the magnetic core, and an output winding inductively coupled to the magnetic core. The magnetic core includes first and second winding legs spaced apart from each other to define an opening. The input winding extends through the opening between the first and second winding legs, and is wound around the first winding leg. The output winding extends through the opening between the first and second winding legs, and is wound around the second winding leg. The input winding and the output winding are foil type windings with a thermally conductive, electrically isolating tape positioned between successive layers of the input winding and the output winding. The thermally conductive, electrically isolating tape includes an electrically insulating layer between two thermally conductive adhesive layers. The electrically insulating layer electrically isolates successive layers of the input winding and the output winding, and the thermally conductive layers dissipate heat generated by the windings. As such, the thermally conductive, electrically isolating tape dissipates heat generated by magnetic assemblies during operation. Additionally, conventional heat dissipation devices (e.g., heat pipes and potting) are bulky and are generally positioned outside of the magnetic assemblies. Because the thermally conductive, electrically isolating tape is arranged in a compact configuration between the windings, the heat is dissipated while reducing the overall volume of the magnetic assembly, allowing the magnetic assembly to fit in compact, high density power electronic circuits.

FIG. 1 is a perspective view of an exemplary magnetic assembly 100, shown in the form of a transformer 100 configured to convert an input voltage to an output voltage. Transformer 100 includes an input side 102 and an output side 104 electrically coupled to one another. While magnetic assembly 100 is described herein with reference to transformer 100, magnetic assembly 100 may be implemented in any suitable electrical architecture that enables magnetic assembly 100 to function as described herein, including, for example, fly back converters, forward converters, inverters, and push-pull converters.

Transformer 100 includes a magnetic core 106, an input winding 108, and an output winding 110. Input winding 108 and output winding 110 are inductively coupled to magnetic core 106 such that at least one transformer and/or inductor are formed within magnetic assembly 100. In the example embodiment, magnetic core 106 has a generally rectangular shape including an input winding leg 112 and an output winding leg 114. As used herein, the term "winding leg" refers to a leg of magnetic core 106 around which at least one of input winding 108 and output winding 110 are wound. In alternative embodiments, magnetic core 106 may have any suitable shape with any suitable number of winding legs and windings that enable magnetic assembly 100 to function as described herein. For example, magnetic core 106 may include one, three, or more winding legs and one, three, or more windings. Additionally, in alternative embodiments, transformer 100 may include any number of magnetic cores 106 that enable transformer 100 to operate as described herein.

Input winding leg 112 and output winding leg 114 are spaced apart from one another a sufficient distance to receive one or more segments of input winding 108 and output winding 110 therebetween. Specifically, magnetic core 106 includes a top portion 116 and a bottom portion 118. Top portion 116 and bottom portion 118 are coupled to input winding leg 112 and output winding leg 114 such that the generally rectangular shape of magnetic core 106 is formed and an opening 120 is defined within magnetic core 106. In the example embodiment, opening 120 is defined by input winding leg 112, output winding leg 114, top portion 116, and bottom portion 118. Opening 120 is sized to receive at least input winding 108 and output winding 110, although in other suitable embodiments, opening 120 may be defined by components other than input winding leg 112, output winding leg 114, top portion 116, and bottom portion 118.

Magnetic core 106 may be constructed from any suitable material that enables magnetic assembly 100 to function as described herein, including ferrite, ferrite polymer composites, powdered iron, sendust, laminated cores, tape wound cores, silicon steel, nickel-iron alloys (e.g., MuMETAL®, MuMETAL is a registered trademark of Magnetic Shield Corporation), amorphous metals, and combinations thereof. In the example embodiment, input winding leg 112, output winding leg 114, top portion 116, and bottom portion 118 are fabricated from a single piece of magnetic material, such as ferrite.

As noted above, input winding 108 and output winding 110 are each inductively coupled to magnetic core 106. More specifically, input winding 108 is wound around input winding leg 112, and output winding 110 is wound around output winding leg 114. Input winding 108 and output winding 110 may be constructed from any suitable conductive material that enables magnetic assembly 100 to function as described herein, including, for example, copper. Input winding 108 and output winding 110 may be constructed from the same conductive material or different conductive materials. In the example embodiment, input winding 108 and output winding 110 are each constructed from foil conductive material or foil type conductive material, and are separately wound around input winding leg 112 and output winding leg 114. In an alternative embodiment, input winding 108 and output winding 110 are assembled in an interleaved configuration such that the conductive sheets of input winding 108 are interposed between the conductive sheets of output winding 110 on a single winding leg. As used herein, the term "foil" refers to a thin sheet of metallic, substantially malleable material having a length, a width, and a thickness, where the length and the width are substantially longer than the thickness. Furthermore, as used herein, the terms "foil conductive material" or "foil type conductive material" refer to a thin sheet of conductive material having a length, a width, and a thickness, where the length and the width are substantially longer than the thickness. In the embodiments described herein, foil conductive material or foil type conductive material include, without limitation, copper foil sheets and aluminum foil sheets.

Input winding 108 includes a first terminal 122 and a second terminal 124. First terminal 122 and second terminal 124 are configured to be electrically coupled to an electronic circuit. Further, output winding 110 includes a first terminal 126 and a second terminal 128. First terminal 126 and second terminal 128 are configured to be electrically coupled to an electronic circuit.

During operations, a first electric current flows into first terminal end 124, through input winding 108, and out second terminal 124. Input winding 108 converts or transforms the first electric current into a magnetic field. Output winding 110 converts or transforms the magnetic field into a second electric current that flows through first terminal 126 and second terminal 128. The voltage of the first electric current is different than the voltage of the second electric current.

Figure 2:
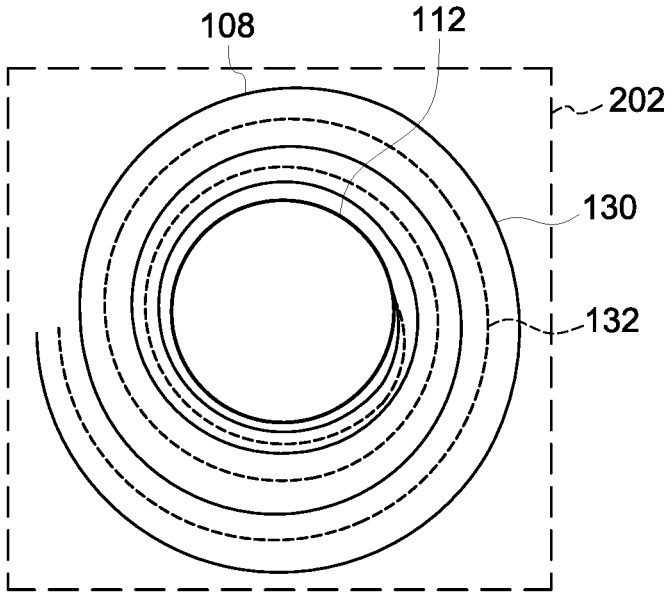
FIG. 2 is a sectional view of an example winding leg suitable for use in the magnetic assembly shown in FIG. 1.

FIG. 2 is a schematic sectional view of input winding 108 and input winding leg 112. Output winding 110 and output winding leg 114 are substantially similar to input winding 108 and input winding leg 112. In the exemplary embodiment, input winding leg 112 has a circular cross section. In alternative embodiments, input winding leg 112 may have any suitable cross section that enables magnetic assembly 100 to function as described herein, including, without limitation, a round cross section, a square cross section, or an oval cross section. In the exemplary embodiment, input winding 108 is wound around input winding leg 112 and includes a foil conductive material 130 (e.g., copper sheets) and a tape 132. Foil conductive material 130 is shown as a solid line and tape 132 is shown as a dashed line in FIG. 2. In the exemplary embodiment, input winding 108 is assembled in an interleaved configuration such that foil conductive material 130 is interposed between tape 132 on a single winding leg (i.e., input winding leg 112). First terminal 122 is electrically coupled to a first end (not shown) of input winding 108 and second terminal 124 is electrically coupled to a second end (not shown) of input winding 108. Tape 132 is a thermally conductive, electrically isolating tape positioned between successive layers of input winding 108. As discussed below, tape 132 includes at least one electrically insulating layer 302, 402 (shown in FIGS. 3 and 4) and at least one thermally conductive adhesive layer 304, 404, and 406 (shown in FIGS. 3 and 4). In the exemplary embodiment, input winding 108 occupies a predetermined total window area 202 (shown as a dashed box in FIG. 2) and includes a predetermined number of turns.

During operation, the first electric current flows through first terminal 122, through input winding 108, and out second terminal 124. Input winding 108 converts or transforms the first electric current into the magnetic field. The first electric current generates heat within input winding 108, which should be dissipated. Thermally conductive adhesive layer 304, 404, and 406 (shown in FIGS. 3 and 4) of tape 132 dissipates the heat generated by input winding 108, preventing thermal runaway or other thermally adverse operating conditions. Thermal runaway is an uncontrolled feedback loop that occurs when an increase in temperature results in conditions that cause further uncontrolled increases in temperature.

In known magnetic assemblies, core 106, input winding 108 and output winding 110 occupy predetermined total window area 202. The addition of tape 132 within input winding 108 enlarges the volume that input winding 108 occupies because the heat dissipating mechanism, tape 132, is positioned between successive layers of input winding 108. In the exemplary embodiment, predetermined total window area 202 is enlarged to accommodate the increased volume of input winding 108. However, predetermined total window area 202 of input winding 108 with tape 132 is not as large as a total window area of an input winding with potting or heat pipes. That is, tape 132 dissipates the heat generated by input winding 108 while occupying less volume than an input winding using potting or a heat pipe as the heat dissipation mechanism.

In alternative embodiments, rather than increasing predetermined total window area 202 to accommodate the increased volume of input winding 108, the thickness of foil conductive material 130 is reduced to reduce the volume of input winding 108. That is, predetermined total window area 202 is not increased and the volume of input winding 108 is not increased. Rather, the volume of foil conductive material 130 is reduced to ensure that input winding 108 fits within predetermined total window area 202. Specifically, the thickness of foil conductive material 130 is reduced such that foil conductive material 130 still has the same number of turns, but with a reduced volume.

Figure 3:
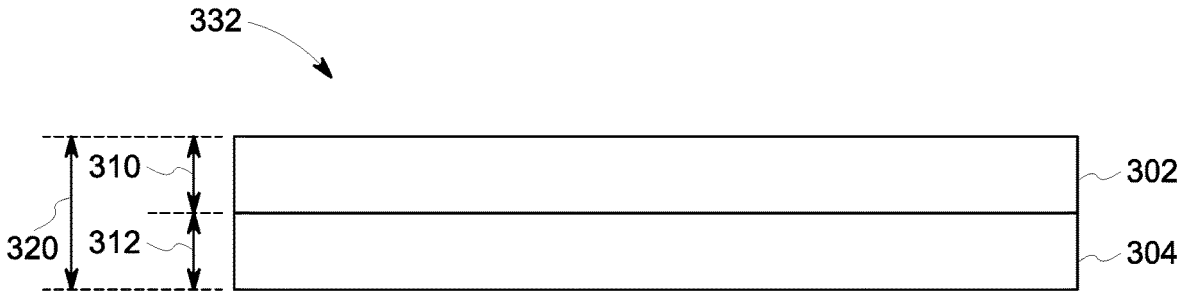
FIG. 3 is a schematic end view of a thermally conductive, electrically isolating tape suitable for use in the winding leg shown in FIG. 2.

FIG. 3 is a schematic end view of a thermally conductive, electrically isolating tape 332. In the exemplary embodiment, tape 332 includes an electrically insulating layer 302 and a thermally conductive adhesive layer 304. Electrically insulating layer 302 has an electrically insulating layer thickness 310 and thermally conductive adhesive layer 304 has a thermally conductive adhesive layer thickness 312. Tape 332 has an overall thickness 320 which is the sum of electrically insulating layer thickness 310 and thermally conductive adhesive layer thickness 312. In the exemplary embodiment, electrically insulating layer thickness 310 includes thicknesses in a range from about 0.5 thousandths of an inch (mil) to about 2.5 mil. In the exemplary embodiment, electrically insulating layer thickness 310 is about 1.0 mil. In the exemplary embodiment, thermally conductive adhesive layer thickness 312 includes thicknesses in a range from about 0.75 mil to about 2.0 mil. In the exemplary embodiment, thermally conductive adhesive layer thickness 312 is about 1.0 mil. In the exemplary embodiment, overall thickness 320 includes thicknesses in a range from about 1.75 mil to about 4.5 mil.

In the exemplary embodiment, electrically insulating layer 302 includes a polyester film. In alternative embodiments, electrically insulating layer 302 includes a biaxially-oriented polyethylene terephthalate film or a 4,4'-oxydiphenylene-pyromellitimide film. In alternative embodiments, electrically insulating layer 302 includes polyimide. In the exemplary embodiment, electrically insulating layer 302 has an electrical resistivity in a range from about $10^{10}$ Ω*m to about $10^{12}$ Ω*m.

In the exemplary embodiment, thermally conductive adhesive layer 304 includes a thermoset adhesive such as a thermally conductive polymer composite or a thermally conductive elastomer coating. In the exemplary embodiment, thermally conductive adhesive layer 304 has a thermal conductivity in a range from about 0.5 W/m*K to about 3.5 W/m*K. In the exemplary embodiment, thermally conductive adhesive layer 304 has a dielectric strength in a range from about 250 V/mil to more than 1000 V/mil.

Figure 4:
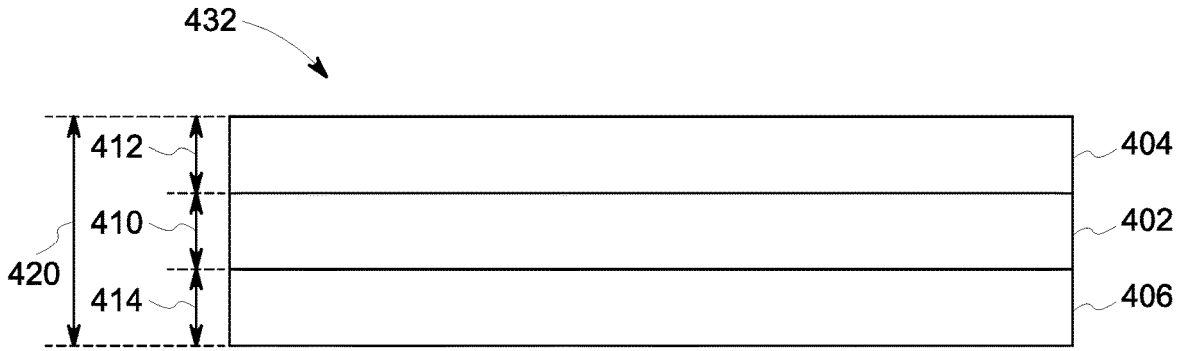
FIG. 4 is a schematic end view of another thermally conductive, electrically isolating tape suitable for use in the winding leg shown in FIG. 2.

FIG. 4 is a schematic end view of another thermally conductive, electrically isolating tape 432. In the exemplary embodiment, tape 432 includes an electrically insulating layer 402, a first thermally conductive adhesive layer 404, and a second thermally conductive adhesive layer 406. Electrically insulating layer 402 has an electrically insulating layer thickness 410, first thermally conductive adhesive layer 404 has a first thermally conductive adhesive layer thickness 412, and second thermally conductive adhesive layer 406 has a second thermally conductive adhesive layer thickness 414. Tape 432 has an overall thickness 420 which is the sum of electrically insulating layer thickness 410, first thermally conductive adhesive layer thickness 412, and second thermally conductive adhesive layer thickness 414. In the exemplary embodiment, electrically insulating layer thickness 410 includes thicknesses in a range from about 0.5 mil to about 2.0 mil. In the exemplary embodiment, electrically insulating layer thickness 410 is about 1.0 mil. In the exemplary embodiment, first thermally conductive adhesive layer thickness 412 includes thicknesses in a range from about 0.75 mil to about 2.0 mil. In the exemplary embodiment, second thermally conductive adhesive layer thickness 414 includes thicknesses in a range from about 0.75 mil to about 2.0 mil. In the exemplary embodiment, overall thickness 420 includes thicknesses in a range from about 2.0 mil to about 6.0 mil.

Tape 332 and tape 432 each dissipate heat generated by input winding 108. Tape 332 includes a single thermally conductive adhesive layer 304 on one side of tape 332 while tape 432 includes two thermally conductive adhesive layers 404 and 406 positioned on opposite sides of tape 432. As such, tape 432 is typically thicker than tape 332. However, in some embodiments, tape 432 may be capable of dissipating more heat than tape 332. Tape 432 allows for more uniform heat distribution than tape 332 and reduces the possibility of hot spots within transformer 100. Hot spots or localized heating can be related to long term reliability issues.

Figure 5:
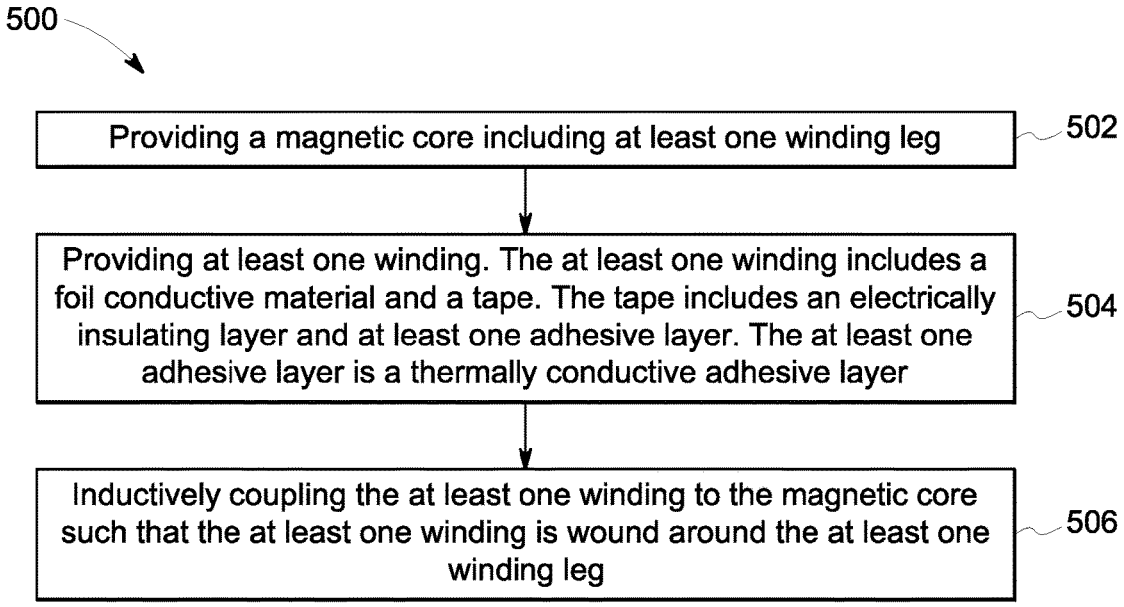
FIG. 5 is a flow diagram of a method of manufacturing the magnetic assembly shown in FIG. 1.

FIG. 5 is a flow diagram of a method 500 of manufacturing the magnetic assembly 100. Method 500 includes providing 502 magnetic core 106 including at least one winding leg 112, 114. Method 500 also includes providing 504 at least one winding 108, 110. The at least one winding 108, 110 includes foil conductive material 108, 110 and tape 132. Tape 132 includes at least one electrically insulating layer 302 and at least one adhesive layer 304. The at least one adhesive layer 304 is a thermally conductive adhesive layer 304. Method 500 further includes inductively coupling 506 the at least one winding 108, 110 to magnetic core 106 such that the at least one winding 108, 110 is wound around the at least one winding leg 112, 114.

Figure 6:
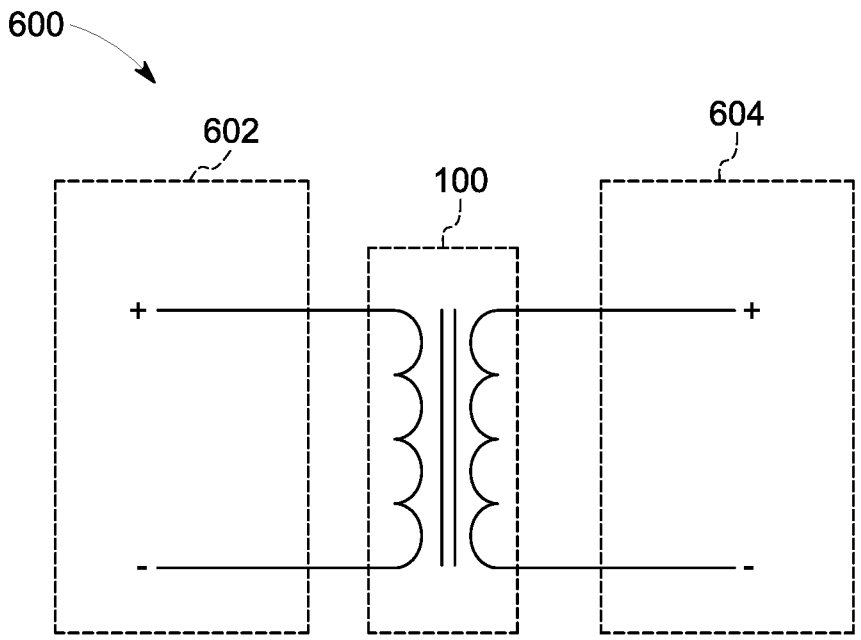
FIG. 6 is a schematic view of an example electronic circuit including the magnetic assembly shown in FIG. 1 in the form of a transformer.

FIG. 6 is a schematic view of an example electronic circuit, shown in the form of a power converter 600 configured to convert an input voltage $V_{in}$ to an output voltage $V_{out}$. Power converter 600 includes an input side 602 and an output side 604 electrically coupled to one another via magnetic assembly 100. In the exemplary embodiment, magnetic assembly 100 is a transformer. As described above, terminal ends 122, 124 of input winding 108 are electrically coupled to input side 602. Terminal ends 126, 128 of output winding 110 are electrically coupled to output side 604. In operation, input side 602 supplies input voltage $V_{in}$ and magnetic assembly 100 transforms the voltage into output voltage $V_{out}$ and supplies the output voltage $V_{out}$ to output side 604.

Figure 7:
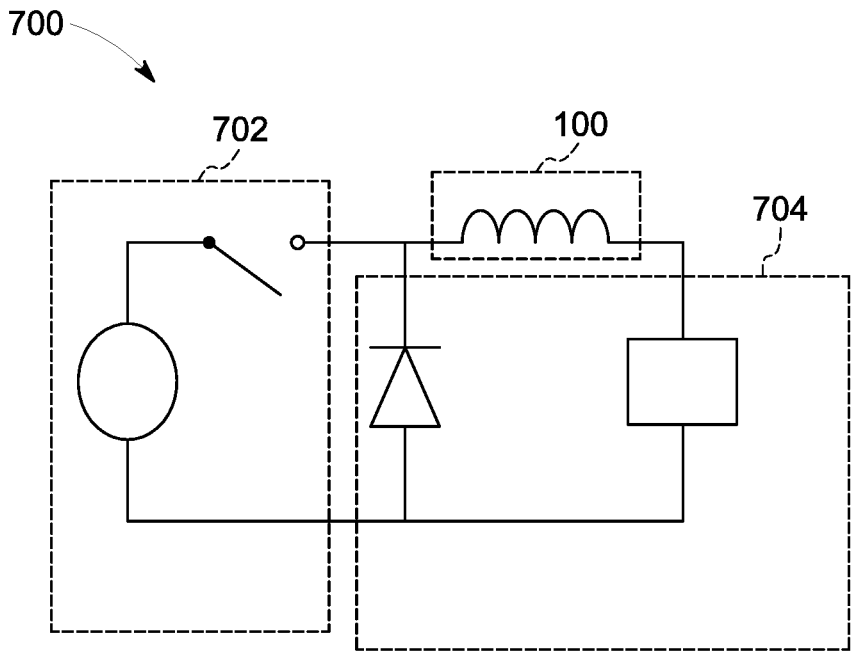
FIG. 7 is a schematic view of an example electronic circuit including the magnetic assembly shown in FIG. 1 in the form of an inductor.

FIG. 7 is a schematic view of an example electronic circuit, shown in the form of a power converter 700 configured to store energy and to convert an input voltage $V_{in}$ to an output voltage $V_{out}$. Power converter 700 includes an input side 702 and an output side 704 electrically coupled to one another via magnetic assembly 100. In the exemplary embodiment, magnetic assembly 100 is an inductor including only a single winding (input winding 108) wound around a single core (input winding leg 112. First terminal end 122 of input winding 108 is electrically coupled to input side 702. Second terminal end 124 of input winding 108 is electrically coupled to output side 704. In operation, input side 602 supplies input voltage $V_{in}$ and magnetic assembly 100. Magnetic assembly 100 creates a magnetic field which stores energy and transforms the voltage into output voltage $V_{out}$ and supplies the output voltage $V_{out}$ to output side 704.

Example embodiments of magnetic assemblies are described herein. A magnetic assembly includes a magnetic core, an input winding inductively coupled to the magnetic core, and a output winding inductively coupled to the magnetic core. The magnetic core includes and first and second winding legs spaced apart from each other to define an opening. The input winding extends through the opening between the first and second winding legs, and is wound around the first winding leg. The output winding extends through the opening between the first and second winding legs, and is wound around the second winding leg. The input winding and the output winding are foil type windings with a thermally conductive, electrically isolating tape positioned between successive layers of the input winding and the output winding. The thermally conductive, electrically isolating tape includes an electrically insulating layer between two thermally conductive adhesive layers. The electrically insulating layer electrically isolates successive layers of the input winding and the output winding and the thermally conductive layers dissipate heat generated by the windings. As such, the thermally conductive, electrically isolating tape dissipates heat generated by magnetic assemblies during operations. Additionally, conventional heat dissipation devices (e.g., heat pipes and potting) are bulky and are generally positioned outside of the magnetic assemblies. Because the thermally conductive, electrically isolating tape is arranged in a compact configuration between the windings, the heat is dissipated while reducing the overall volume of the magnetic assembly, allowing the magnetic assembly to fit in compact high density power electronic circuits.

Exemplary technical effects of the systems and methods described herein include, for example: (a) reducing a temperature of a magnetic assembly; (b) reducing the volume of magnetic assemblies; (c) dissipating heat generated by foil windings; and (d) arranging magnetic assemblies with heat dissipation devices in a compact configuration.

Exemplary embodiments of magnetic assemblies and related components are described above in detail. The magnetic assemblies are not limited to the specific embodiments described herein, but rather, components of systems and/or steps of the methods may be utilized independently and separately from other components and/or steps described herein. For example, the configuration of components described herein may also be used in combination with other processes, and is not limited to practice with the systems and related methods as described herein. Rather, the exemplary embodiment can be implemented and utilized in connection with many applications where magnetic assemblies are desired.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

Although specific features of various embodiments of the present disclosure may be shown in some drawings and not in others, this is for convenience only. In accordance with the principles of the present disclosure, any feature of a drawing may be referenced and/or claimed in combination with any feature of any other drawing.

This written description uses examples to disclose the embodiments of the present disclosure, including the best mode, and also to enable any person skilled in the art to practice the disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A magnetic assembly comprising:

a magnetic core comprising at least one winding leg; and at least one winding inductively coupled to said magnetic core and wound around said at least one winding leg, said at least one winding comprising at least one foil conductive material and a tape, said tape comprising a thermally conductive adhesive layer and an electrically insulating layer, wherein the thermally conductive adhesive layer dissipates heat generated by the at least one winding, thereby maintaining an operating temperature of the magnetic assembly while reducing a total window area occupied by the at least one winding compared to a total window area of a winding with a separately-provided heat dissipation mechanism due to the tape occupying less volume than the winding with the separately-provided heat dissipation mechanism, wherein the magnetic assembly is compact due to the reduced total window area occupied by the at least one winding.

2. A magnetic assembly in accordance with claim 1, wherein said thermally conductive adhesive layer comprises a thermoset adhesive.

3. A magnetic assembly in accordance with claim 1, wherein said thermally conductive adhesive layer comprises a thermally conductive polymer composite.

4. A magnetic assembly in accordance with claim 1, wherein said thermally conductive adhesive layer comprises a thermally conductive elastomer coating.

5. A magnetic assembly in accordance with claim 1, wherein said electrically insulating layer comprises a polyester film.

6. A magnetic assembly in accordance with claim 1, wherein a thickness of the tape is in a range from approximately 1.75 mil (44.45 μm) to approximately 6 mil (152.4 μm).

7. A magnetic assembly in accordance with claim 1, wherein the thermally conductive adhesive layer has a dielectric strength in a range from about 250 V/mil to more than 1000 V/mil.

8. A magnetic assembly in accordance with claim 1, wherein said electrically insulating layer has an electrical resistivity in a range from about $10^{10}$ Q*m to about $10^{12}$ Q*m.

9. A magnetic assembly in accordance with claim 1, wherein said adhesive layer has a thermal conductivity in a range from about 0.5 W/m*K to about 3.5 W/m*K.

10. A method of assembling a magnetic assembly, said method comprising:

assembling (i) a magnetic core including at least one winding leg, and (ii) at least one winding including a foil conductive material and a tape, the tape including an electrically insulating layer and at least one thermally conductive adhesive layer, wherein the at least one thermally conductive adhesive layer dissipates heat generated by the at least one winding, thereby maintaining an operating temperature of the magnetic assembly while reducing a total window area occupied by the at least one winding compared to a total window area of a winding with a separately-provided heat dissipation mechanism due to the tape occupying less volume than the winding with the separately-provided heat dissipation mechanism; and inductively coupling the at least one winding to the magnetic core by winding the at least one winding around the at least one winding leg, wherein an overall volume of the magnetic assembly is reduced due to the reduced total window area of the at least one winding.

11. A method of assembling a magnetic assembly in accordance with claim 10, wherein the magnetic core includes only one winding leg.

12. A method of assembling a magnetic assembly in accordance with claim 10, wherein the at least one winding leg comprises an input winding leg and an output winding leg.

13. A method of assembling a magnetic assembly in accordance with claim 12, wherein inductively coupling the at least one winding around the at least one winding leg comprises inductively coupling an input winding to the input winding leg and inductively coupling an output winding to the output winding leg.

14. A magnetic assembly comprising:

a magnetic core comprising a first winding leg and a second winding leg, wherein the first winding leg and the second winding leg spaced apart and defining an opening;

an input winding inductively coupled to said magnetic core, the input winding extending through the opening and wound around said first winding leg, said input winding comprising a first foil conductive material and a first tape, said first tape comprising a first electrically insulating layer and two first thermally conducive adhesive layers positioned on opposite sides of said first electrically insulating layer, wherein the two first thermally conductive adhesive layers dissipate heat generated by the input winding, thereby maintaining an operating temperature of the magnetic assembly while reducing a total window area occupied by the input winding compared to a total window area of an input winding with a separately-provided heat dissipation mechanism due to the first tape occupying less volume than the input winding with the separately-provided heat dissipation mechanism; and an output winding inductively coupled to said magnetic core, the output winding extending through the opening and wound around said second winding leg, said output winding comprising a second foil conductive material and a second tape, said second tape comprising a second electrically insulating layer and two second thermally conducive adhesive layers positioned on opposite sides of said second electrically insulating layer, wherein the two second thermally conductive adhesive layers dissipate heat generated by the output winding, thereby maintaining the operating temperature of the magnetic assembly while reducing a total window area occupied by the output winding compared to a total window area of an output winding with the separately-provided heat dissipation mechanism due to the second tape occupying less volume than the output winding with the separately-provided heat dissipation mechanism, wherein an overall volume of the magnetic assembly is reduced due to the reduced total window area occupied by the input winding and the reduced total window area occupied by the output winding.

15. A magnetic assembly in accordance with claim 14, wherein at least one of said two first adhesive layers comprises a thermally conductive polymer composite, and wherein at least one of said two second adhesive layers comprises a thermally conductive polymer composite.

16. A magnetic assembly in accordance with claim 14, wherein at least one of said two first adhesive layers comprises a thermally conductive elastomer coating, and wherein at least one of said two second adhesive layers comprises a thermally conductive elastomer coating.

17. A magnetic assembly in accordance with claim 14, wherein said first electrically insulating layer comprises a polyester film, and wherein said second electrically insulating layer comprises a polyester film.

18. A magnetic assembly in accordance with claim 14, wherein said first electrically insulating layer comprises a biaxially-oriented polyethylene terephthalate film, and wherein said second electrically insulating layer comprises a biaxially-oriented polyethylene terephthalate film.

19. A method of assembling a magnetic assembly in accordance with claim 10, wherein the tape has a thickness in a range from approximately 1.75 mil (44.45 μm) to approximately 6 mil (152.4 μm).

20. A magnetic assembly in accordance with claim 14, wherein the first tape has a thickness in a range from approximately 2 mil (50.8 μm) to approximately 6 mil (152.4 μm) and the second tape has the thickness in the range from approximately 2 mil (50.8 μm) to approximately 6 mil (152.4 μm).

* * * * *